US009630757B1

(12) United States Patent
Capous

(10) Patent No.: US 9,630,757 B1
(45) Date of Patent: Apr. 25, 2017

(54) SELF-LOCKING PARCEL DELIVERY BOX

(71) Applicant: Nicholas George Capous, Sacramento, CA (US)

(72) Inventor: Nicholas George Capous, Sacramento, CA (US)

( * ) Notice: Subject to any disclaimer, the term of this patent is extended or adjusted under 35 U.S.C. 154(b) by 85 days.

(21) Appl. No.: 14/881,351

(22) Filed: Oct. 13, 2015

(51) Int. Cl.

| | |
|---|---|
| ***A47G 29/12*** | (2006.01) |
| ***A45C 13/10*** | (2006.01) |
| ***B65D 55/14*** | (2006.01) |
| ***B65D 43/16*** | (2006.01) |
| ***B65D 43/22*** | (2006.01) |
| *A47G 29/14* | (2006.01) |
| *A47G 29/16* | (2006.01) |
| *A47G 29/20* | (2006.01) |

(52) U.S. Cl.
CPC ..... *B65D 55/14* (2013.01); *B65D 43/16* (2013.01); *B65D 43/22* (2013.01); *A47G 29/14* (2013.01); *A47G 29/16* (2013.01); *A47G 29/20* (2013.01)

(58) Field of Classification Search
CPC ..... A47G 29/12; A47G 29/14; A47G 29/16; A47G 29/20; B65D 43/16; B65D 43/22; B65D 55/14
USPC ..... 206/1.5; 70/63; 220/210, 212, 326; 232/1 A, 19, 20, 27, 29, 30, 31, 33, 41 D, 232/45; 312/211, 306, 333
See application file for complete search history.

(56) References Cited

U.S. PATENT DOCUMENTS

| | | | | |
|---|---|---|---|---|
| 3,837,566 | A * | 9/1974 | McGough | G07F 9/06 232/15 |
| 6,375,070 | B1 * | 4/2002 | Snoke | A47G 29/141 232/20 |
| 6,540,134 | B1 * | 4/2003 | Rasche | B65D 11/18 220/4.28 |
| 7,175,071 | B1 * | 2/2007 | Slagle | A47G 29/16 220/833 |
| 7,743,935 | B2 * | 6/2010 | Maid | A47G 29/20 220/210 |
| 8,336,759 | B2 * | 12/2012 | Skouboe | A47G 29/124 232/45 |
| 8,358,199 | B2 * | 1/2013 | Nesling | A47G 29/141 232/20 |
| 2001/0045449 | A1 * | 11/2001 | Shannon | A47G 29/141 232/19 |
| 2006/0196780 | A1 * | 9/2006 | Horngren | G08B 13/06 206/1.5 |

* cited by examiner

*Primary Examiner* — Luan K Bui
(74) *Attorney, Agent, or Firm* — Craig A. Simmermon

(57) ABSTRACT

Self-locking parcel delivery box is a container with a special locking mechanism that allows a hinged lid to remain unlocked and openable while the container is empty but then automatically lock shut after a package or parcel has been placed inside and the hinged lid is closed. Special locking mechanism comprises, among other things, a rotating striker plate that remains in a closed position while container is empty but then rotates to an open position when a package or parcel is placed inside container. With rotating striker plate in the closed position, a latch cannot extend outward to latch or lock into a latch window when the hinged lid is closed, thereby keeping hinged lid unlocked and openable. With rotating striker plate in the open position, the latch will latch or lock into the latch window when the hinged lid is closed, thereby allowing hinged lid to lock shut.

1 Claim, 6 Drawing Sheets

SELF-LOCKING PARCEL DELIVERY BOX

BACKGROUND OF THE INVENTION

1. Field of the Invention

This invention relates to package or parcel delivery boxes and specifically to package or parcel delivery boxes with self-locking mechanisms that allow the package or parcel delivery box to remain open and unlocked when empty but automatically lock after a package or parcel is placed inside and the lid is closed.

2. Description of Related Art

There are other self-locking package or parcel delivery boxes in the prior art however none disclose a self-locking mechanism as described below.

BRIEF SUMMARY OF THE INVENTION

Self-locking parcel delivery box is a container with a special locking mechanism that allows a hinged lid to remain unlocked and openable while the container is empty but then automatically lock shut after a package or parcel has been placed inside the container and the hinged lid is closed. Special locking mechanism comprises, among other things, a rotating striker plate that remains in a closed position while container is empty but then rotates to an open position when a package or parcel is placed inside container. With rotating striker plate in the closed position, a spring loaded latch cannot extend outward to latch or lock into a latch window when the hinged lid 86 is closed, thereby keeping hinged lid unlocked and openable. With rotating striker plate is in the open position, the spring loaded latch will latch and lock into latch window when the hinged lid is closed, thereby locking hinged lid shut.

DEFINITION LIST

Figure 1:
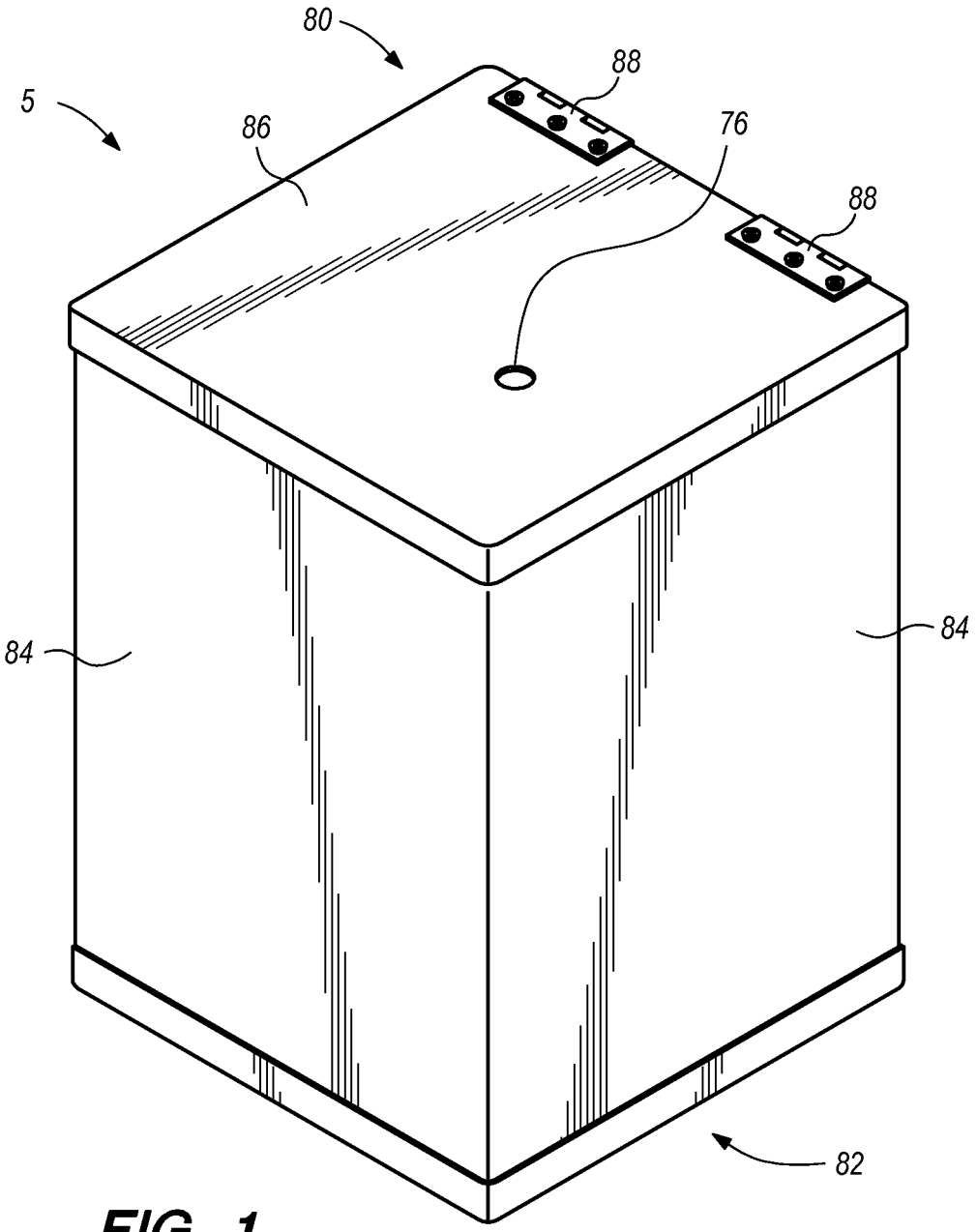
FIG. 1 is a top perspective view of self-locking parcel delivery box.
Figure 2:
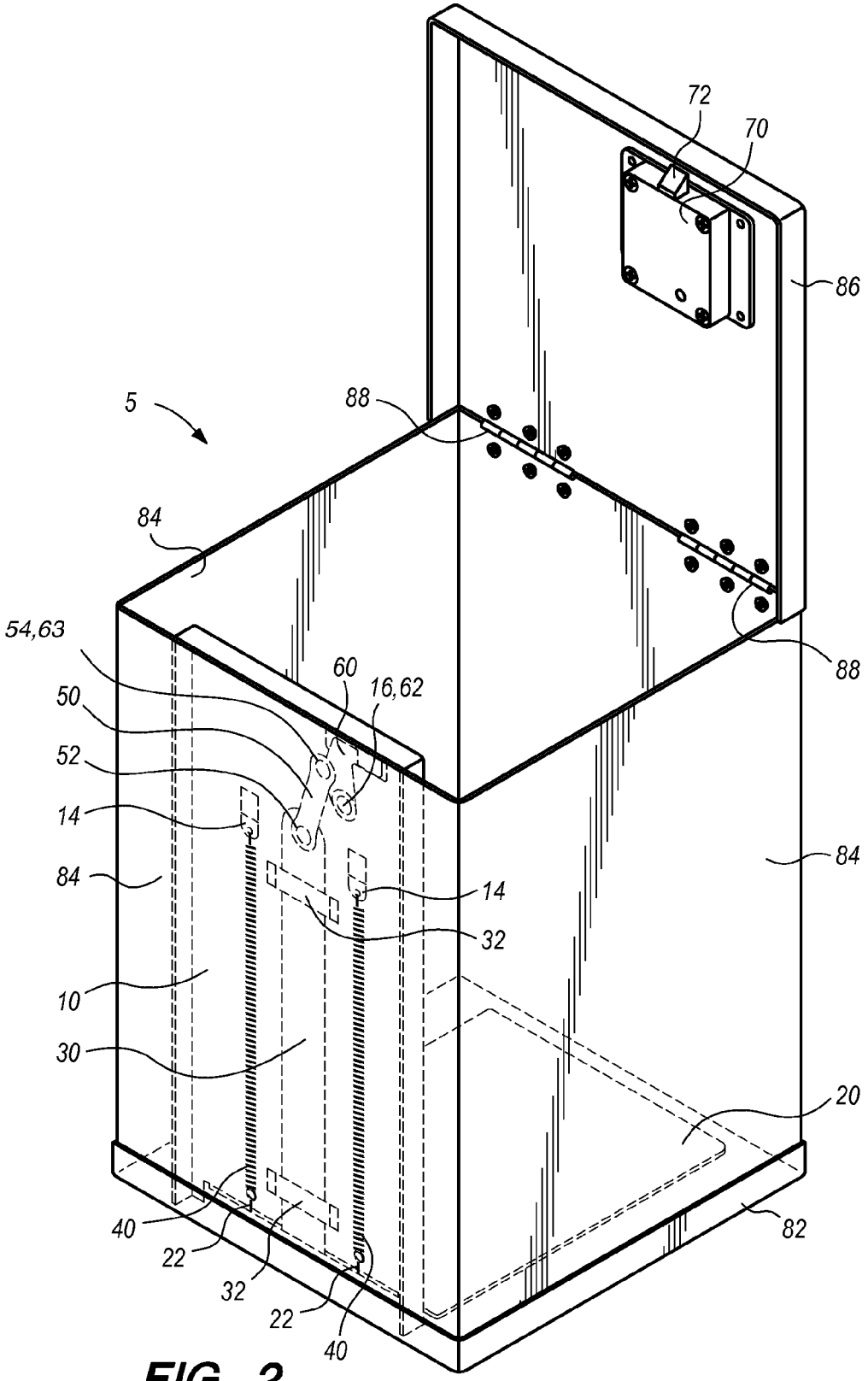
FIG. 2 is a top perspective view of self-locking parcel delivery box with hidden view of self-locking mechanism.
Figure 3:
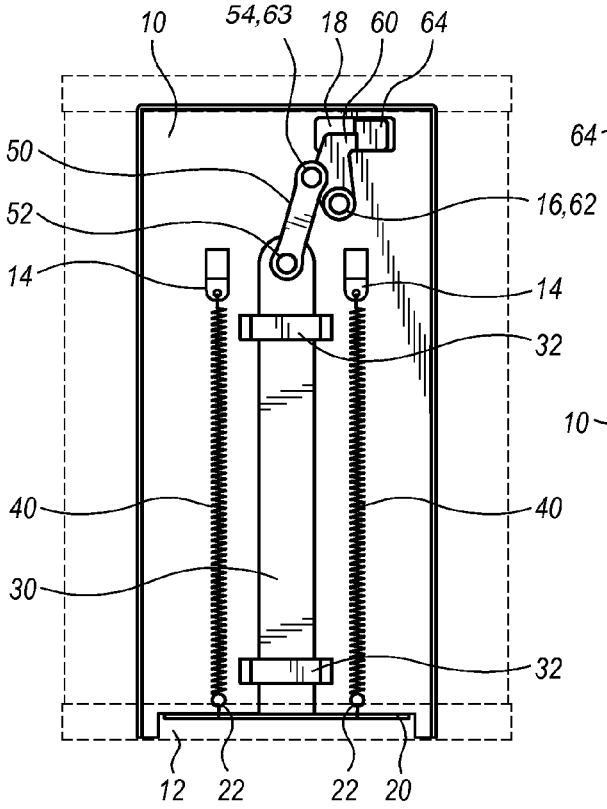
FIG. 3 is a front elevation view of self-locking parcel delivery box with hidden view of self-locking mechanism.
Figure 4:
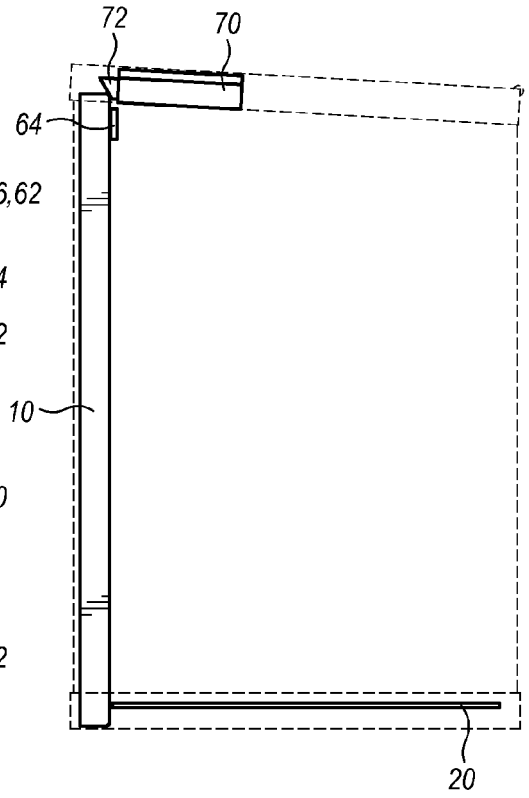
FIG. 4 is a side elevation view of self-locking parcel delivery box with hidden view of self-locking mechanism.
Figure 5:
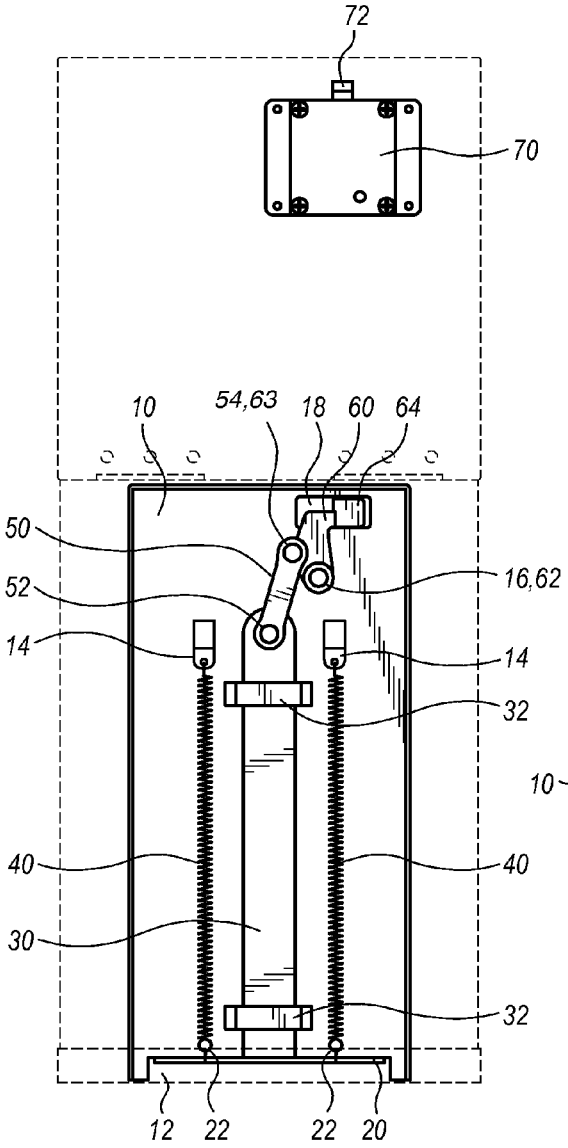
FIG. 5 is a front elevation view of self-locking parcel delivery box with hidden view of self-locking mechanism just before a package or parcel is placed inside self-locking parcel delivery box.
Figure 6:
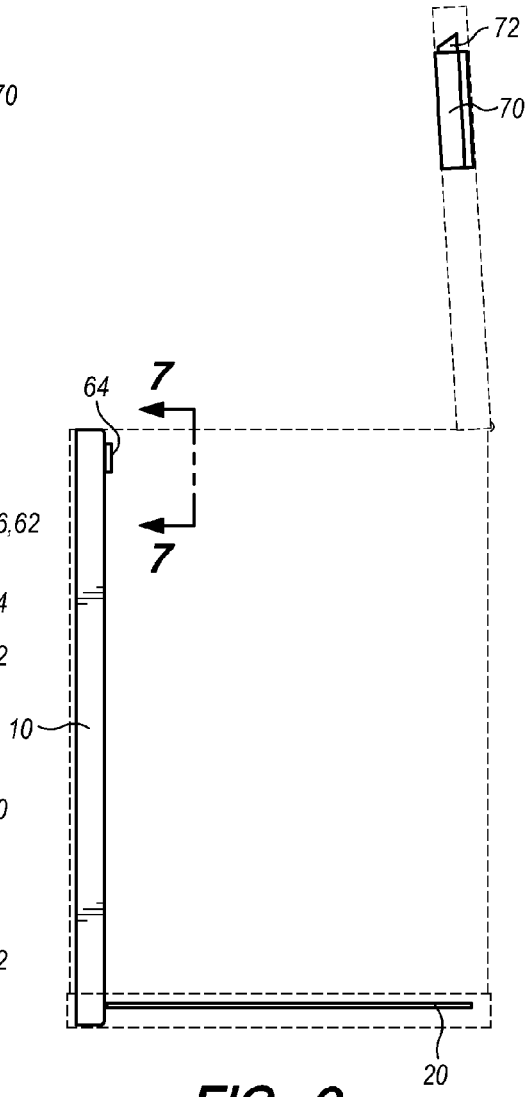
FIG. 6 is a side elevation view of self-locking parcel delivery box with hidden view of self-locking mechanism just before a package or parcel is placed inside self-locking parcel delivery box.
Figure 7:
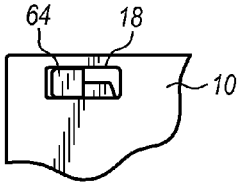
FIG. 7 is a blowup view of the inner surface of striker plate window just before a package or parcel is placed inside self-locking parcel delivery box.
Figure 8:
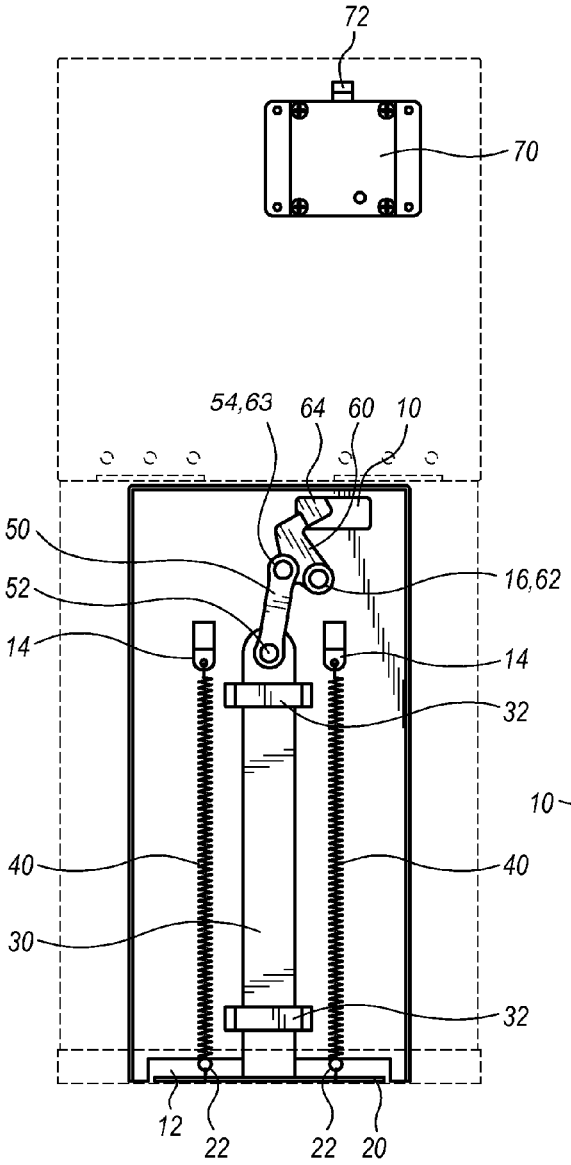
FIG. 8 is a front elevation view of self-locking parcel delivery box with hidden view of self-locking mechanism just after a package or parcel was placed inside self-locking parcel delivery box.
Figure 9:
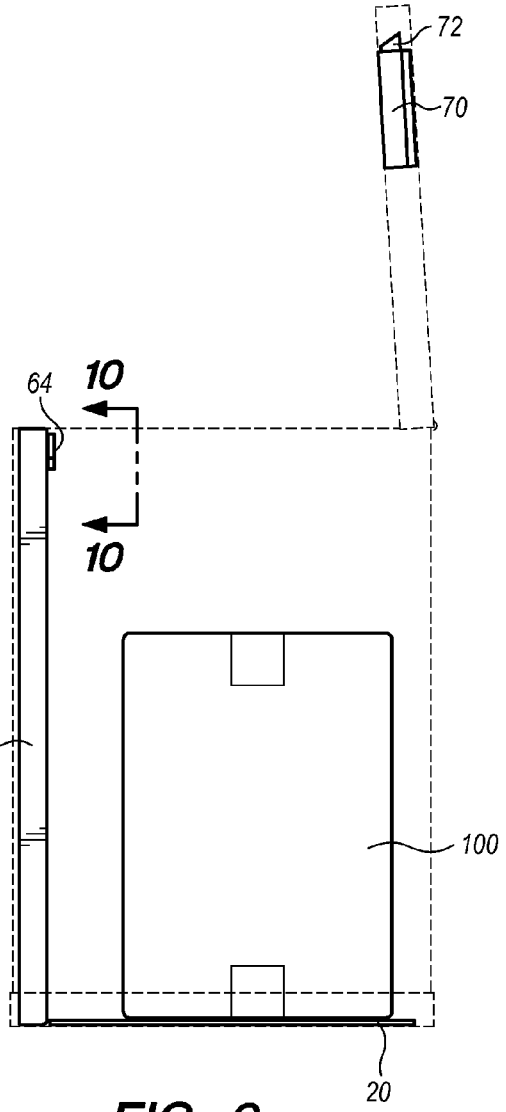
FIG. 9 is a side elevation view of self-locking parcel delivery box with hidden view of self-locking mechanism just after a package or parcel was placed inside self-locking parcel delivery box.
Figure 10:
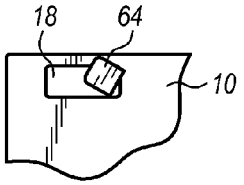
FIG. 10 is a blowup view of the inner surface of striker plate window just after a package or parcel was placed inside self-locking parcel delivery box.
Figure 11:
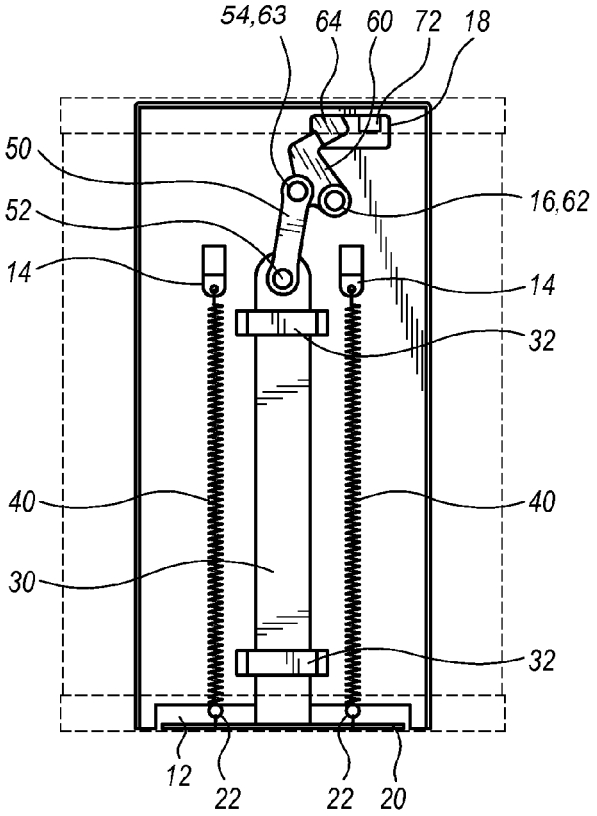
FIG. 11 is a front elevation view of self-locking parcel delivery box with hidden view of self-locking mechanism after a package or parcel was placed inside self-locking parcel delivery box and hinged lid has been closed to lock hinged lid shut.
Figure 12:
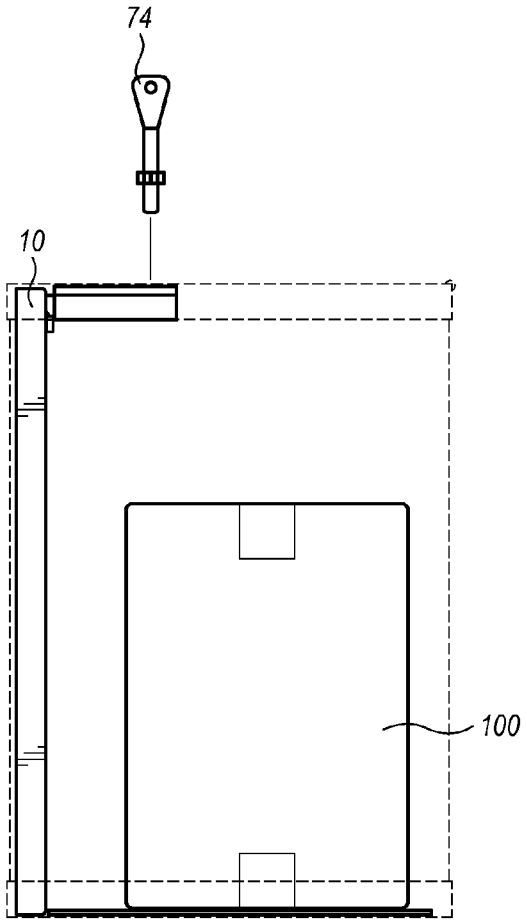
FIG. 12 is a side elevation view of self-locking parcel delivery box with hidden view of self-locking mechanism after a package or parcel was placed inside self-locking parcel delivery box and hinged lid has been closed to lock hinged lid shut.

| Term | Definition |
|---|---|
| 5 | Self-Locking Parcel Delivery Box |
| 10 | Vertical Support Plate |
| 12 | Floating Base Plate Window |
| 14 | Spring Attachment Point on Vertical Support Plate |
| 16 | Rotating Striker Plate Pivotal Attachment Means |
| 18 | Striker Plate Window |
| 20 | Floating Base Plate |
| 22 | Spring Attachment Point on Floating Base Plate |
| 30 | Floating Stanchion |
| 32 | Slideable Attachment Means |
| 40 | Spring |
| 50 | Swing Arm |
| 52 | Lower Pivotal Attachment Means |
| 54 | Upper Pivotal Attachment Means |
| 60 | Rotating Strike Plate |
| 62 | Vertical Support Plate Pivotal Attachment Point on Rotating Striker Plate |
| 63 | Swing Arm Pivotal Attachment Point on Rotating Striker Plate |
| 64 | Striker Plate Protrusion |
| 70 | Latch Assembly |
| 72 | Spring Loaded Latch |
| 74 | Key |
| 76 | Keyhole |
| 80 | Container |
| 82 | Container Bottom |
| 84 | Container Side |
| 86 | Hinged Lid |
| 88 | Hinge |
| 100 | Package or Parcel |

DETAILED DESCRIPTION OF THE INVENTION

Self-locking parcel delivery box 5 comprises: a vertical support plate 10, a floating base plate 20, a floating stanchion 30, at least one spring 40, a swing arm 50, a striker plate 60, a latch assembly 70, and a container 80.

Container 80 comprises: a container bottom 82, at least one container side 84, a hinged lid 86, and a hinge 88. Container 80 is a secure hollow container in the shape of a rectangular cuboid, a cube, or a cylinder with an interior and an exterior. Container 80 is impervious to water. In the cases of a rectangular cuboid shaped container 80 and a cube shaped container 80, container 80 comprises four container sides 84 that are each rigid planar members that are impervious to water with a width, a height, an inner surface, an outer surface, an upper end, and a lower end. In the case of a cylindrical shaped container 80, container 80 comprises one container side 84 that is a rigid cylindrical shaped member that is impervious to water with a circumference, a height, an inner surface, an outer surface, an upper end, and a lower end. Container bottom 82 is a rigid planar member that is impervious to water with an upper surface and a lower surface. Inner surfaces of container sides 84 face the interior of container 80. Exterior surfaces of container sides 84 face the exterior of container 80. In the case of a rectangular cuboid shaped container 80, container bottom 82 is rectangular shaped or square shaped. In the case of a cube shaped container 80, container bottom 82 is square shaped. In the case of a cylindrical shaped container 80, container bottom 82 is circular shaped. All outer edges of container bottom 82 are rigidly attached to container side(s) 84 to form a watertight connection or seam there between. Watertight connection or seam must be sturdy, waterproof, weatherproof, and able to withstand attempts to pry the seam open in order to prevent someone from breaking into the container 80. Container bottom 82 and container side(s) 84 form an open-topped watertight receptacle. Hinged lid 86 is a rigid planar member that is impervious to water with an outer edge, an upper surface, and a lower surface. In the case of a rectangular cuboid shaped container 80, hinged lid 86 is rectangular shaped or square shaped. In the case of a cube shaped container 80, hinged lid 86 is square shaped. In the case of a cylindrical shaped container 80, hinged lid 86 is circular shaped. Hinge 88 is a hinge or bearing member that pivotally attaches or connects hinged lid 88 to a container side 84. Hinge 88 is positioned vertically so that its axis of rotation is positioned horizontally. Hinge 88 has an upper end and a lower end. The lower end of hinge 88 is rigidly attached to the upper end of a container side 84. The upper end of hinge 88 is rigidly attached to the outer edge of hinged lid 86. Hinge 88 functions to allow the pivotal attachment of hinge 88 to a side 84 of container 80 to allow for the rotation of hinged lid 82 about hinge 88. Hinged lid 86 rotates upwards to open hinged lid 86 and rotates downwards to close hinged lid 86. When hinged lid 86 is closed, it is positioned horizontally and forms a waterproof and weatherproof connection with the upper end(s) of all container side(s) 84. When hinged lid 86 is closed and locked shut, it forms sturdy connection with the upper end(s) of all container side(s) 84 that is able to withstand attempts to pry hinged lid 86 open in order to prevent someone from breaking into container 80 when it is locked shut. In best mode, there are two hinges 88.

Vertical support plate 10 is a rigid oblong planar member with an overall width, an overall height, a lower end, an upper end, an inner surface, and an outer surface. Vertical support plate 10 is positioned vertically inside the interior of container 80 with its lower end rigidly affixed to the upper surface container bottom 82 with the longitudinal axis of vertical support plate 20 perpendicular to container bottom 80. The inner surface of vertical support plate 10 faces the interior of container 80. The outer surface of vertical support plate 10 faces the exterior of container 80. Vertical support plate 10 is positioned adjacent to a container side 84 so that there is about 0.125 to 2.0 inches of space between the outer surface of vertical support plate 10 and the inner surface of the adjacent container side 84. Floating stanchion 30, at least one spring 40, swing arm 50, and rotating striker plate 6 are located and housed between the outer surface of vertical support plate 10 and the inner surface of the adjacent container side 84 as depicted. Vertical support plate 10 is a sturdy vertical support member that solely supports floating base plate 20, floating stanchion 30, at least one spring 40, swing arm 50, rotating striker plate 60, and the weight of a package or parcel 100 placed inside self-locking parcel delivery box 5. Floating base plate 20, floating stanchion 30, at least one spring 40, swing arm 50, rotating striker plate 60, and package or parcel 100 move or float upwards and downwards relative to vertical support plate 10, which is stationary and rigidly affixed to container bottom 82. Vertical support plate 10 also functions as a housing, firewall, or divider plate to separate floating stanchion 30, at least one spring 40, swing arm 50, and rotating striker plate 6, which are moving parts, from the interior of container 80 where a package or parcel 100 is placed, in order to all keep moving parts from physically contacting or touching package or parcel 100. Overall width of vertical support plate 10 must be less than the width or circumference of container side 84 and height of vertical support plate 10 must be less than that of container side 84 to allow vertical support plate 10 to fit inside container 80. Any know attachment means may be used to attach lower end of vertical support plate 10 to upper surface of container bottom 82 such as weld, glue, epoxy, bolts, screws, rivets, clips, or snaps. In best mode, vertical support plate 10 is rectangular. Vertical support plate 10 further comprises a floating base plate window 12. Floating base plate window 12 is a rectangular shaped void or notch in the lower end of vertical support plate 10 as depicted. Floating base plate window 12 has a width, a height, a left end, a right end and an upper end. Floating base plate window 12 functions to provide clearance for floating base plate 20 to freely float or move vertically upwards and downwards. The width of floating base plate window 12 is slightly large than the width of floating base plate 20. The height of floating base plate window 12 must be large enough to allow for sufficient vertical movement of floating base plate 20 to yield sufficient rotation of rotating striker plate 60 to allow successful locking and unlocking of latch assembly 70. This mechanism is described in more detail below. Vertical support plate 10 further comprises at least one spring attachment point 14 on its outer surface at its upper end. Typically, there is one spring attachment point 14 for each spring 40. Spring attachment point 14 is a means to reversibly attach the upper end of a spring 40 thereto. Spring attachment means could be any known means such as a hook, a ring, an eye, a hole, a connector, a fitting, fastener, screw, bolt, staple, nail, or any other known means. Vertical support plate 10 further comprises a rotating striker plate pivotal attachment means 16 on its outer surface at its upper end. Rotating striker plate pivotal attachment means 16 functions to pivotally attach rotating striker plate 60 to the outer surface of vertical support member 10 at a location just below rotating striker plate window 18 as depicted. Rotating striker plate pivotal attachment means 16 is a means to pivotally attached rotating striker plate 60 to vertical support plate 10, which could be accomplished by a hinge, a bearing, an axle, a hub, a spindle, a pin, a rivet, a screw, a bolt, or any other know means of pivotal attachment. Vertical support plate 10 further comprises a striker plate window 18. Striker plate window 18 is a rectangular shaped or semi-rectangular shaped void or hole in the upper end of vertical support plate 10 that functions to receive a spring loaded latch 72 when hinged lid 86 is locked shut. Striker plate window 18 must be sized slight larger than spring loaded latch 72 so that spring loaded latch 72 may penetrate through striker plate window in order to lock latch assembly 70 to striker plate window 18. One end of rotating striker plate 60, called the striker plate protrusion 66, is inserted through striker plate window 18 as depicted. Rotating striker plate 60 rotates back and forth within striker plate window 18 in order to either disallow hinged lid 86 from locking shut or to allow hinged lid to lock shut. As discussed below, rotating striker plate 60 rotates back and forth to block striker plate window 18 so that spring loaded latch 72 cannot penetrate into striker plate window 18 or to unblock striker plate window 18 to allow spring loaded latch 72 to penetrate striker plate window 18 and lock hinged lid 86 shut.

Floating base plate 20 is a rigid horizontal planar member with an upper surface and a lower surface. In the case of a rectangular cuboid shaped container 80, floating base plate 20 is rectangular shaped or square shaped. In the case of a cube shaped container 80, floating base plate 20 is square shaped. In the case of a cylindrical shaped container 80, floating base plate 20 is circular shaped. The outer dimensions of floating base plate 20 are slightly smaller than the inner dimensions of container 80 so that floating base plate may freely slide upwards and downwards without its edges touching the inner surface of container side(s) 84 but also without leaving too much clearance to allow for a package or parcel 100 to fall there between. The upper surface of floating base plate 20 is rigidly attached to the lower end of floating stanchion 30. Floating base plate 20 further comprises at least one spring attachment point 22 on its upper surface. Typically, there is one spring attachment point 22 for each spring 40. Spring attachment point 22 is a means to reversibly attached the lower end of spring 40 thereto. Spring attachment means could be accomplished any known means such as a hook, a ring, an eye, a hole, a connector, a fitting, fastener, screw, bolt, staple, nail, or any other known means.

Floating stanchion 30 is a rigid oblong planar member with an overall width, an overall height, a lower end, an upper end, an inner surface, and an outer surface. Floating stanchion 30 is a sturdy vertical support member. Floating stanchion 30 is positioned vertically between the outer surface of vertical support plate 10 and the inner surface of the adjacent container side 84 as depicted. The lower end of floating stanchion 30 is rigidly affixed to the upper surface of floating base plate 20 with the longitudinal axis of floating stanchion 30 perpendicular to floating base plate 20. Floating stanchion 30 further comprises a slideable attachment means 32. Slideable attachment means 32 is a means to slideably attach floating stanchion 30 to the outer surface of vertical support plate 10 so that floating stanchion 30 may slide vertically upwards and downwards, but is prevented from movement in all other directions. Slideable attachment means 32 may be accomplished by any know means such as: wheel and track, tongue and groove, guide, bearing, loop, collar, or any other known means. In best mode, slideable attachment means 32 is two horizontal collars or loops rigidly attached to the inner surface of vertical support member 10, one at the upper end of floating stanchion 30, one at the lower end of floating stanchion 30, with floating stanchion 30 running vertically and inserted through each as depicted. With this mode the two collars or loops each have an inner dimension that is sized to make a slip fit with the outer dimension of the horizontal cross section of floating stanchion 30 so that floating stanchion 30 may freely slide upwards and downwards but is retained from moving in all other directions.

At least one spring 40 is a vertical spring member with an upper end and a lower end. At least one spring 40 is a coil spring, flat spring, machined spring, compression spring, cantilever spring, leaf spring, v-spring, gas spring, torsion spring, hairspring, rubber band, elastic band, or any other type of spring. Best mode at least one spring 40 is a coil spring. The upper end of at least one spring 40 is connected to spring attachment point 14 on vertical base plate 10. The lower end of at least one spring 40 is connected to spring attachment point 22 on floating base plate 20. At least one spring 40 must be of the proper length and tension to apply continuous upward tension on floating base plate 20 to pull the floating base plate 20 all the way upwards to contact and rest against upper end of floating base plate window 12 when there is no package or parcel 100 sitting on the upper surface of floating base plate 20, but still allow the floating base plate 20 fall all the way downwards to rest on the upper surface of container bottom 82 when a package or parcel 100 sitting on the upper surface of floating base plate 20. In best mode, there are two springs 40, where one is positioned on each side of floating stanchion 30 to provide equal or balanced upward tension on each side of floating stanchion 30.

Swing arm 50 is a rigid oblong member with an upper end and a lower end. Swing arm 50 has a lower pivotal attachment means 52 at its lower end and an upper pivotal attachment means 54 at its upper end. Lower pivotal attachment means 52 is a means to pivotally attach the lower end of swing arm 50 to the upper end of floating stanchion 30. Pivotal attachment is such that swing arm 50 may freely rotate around the point of pivotal attachment and remains connected to the upper end of floating stanchion 30. Pivotal attachment could be accomplished by a hinge, a bearing, an axle, a hub, a spindle, a pin, a rivet, a screw, a bolt, or any other know means of pivotal attachment. Upper pivotal attachment means 54 is a means to pivotally attach the upper end of swing arm 50 to swing arm pivotal attachment point 63 on rotating striker plate 60. Pivotal attachment is such that swing arm 50 may freely rotate around the point of pivotal attachment and remains connected to the pivotal attachment point 63 on rotating striker plate 60. Pivotal attachment could be accomplished by a hinge, a bearing, an axle, a hub, a spindle, a pin, a rivet, a screw, a bolt, or any other know means of pivotal attachment.

Rotating striker plate 60 is a rigid tri-planar member wherein two parallel planar members are rigidly connected together by a third planar member perpendicular thereto. Rotating striker plate 60 comprises a plane one, a plane two, and a plane three, each with a first and second end. Planes one and two are parallel to each other and plane three is perpendicular to planes one and two. The first end of plane three rigidly attached to second end of plane one and the second end of plane three rigidly attached to first end of plane two to yield a rigid step-shaped structure with two steps. Rotating striker plate 60 is positioned within rotating striker plate window 18 so that: plane one is adjacent to and parallel with the outer surface of vertical support plate 10, plane two is adjacent to and parallel with the inner surface of vertical support plate 10, and plane three is perpendicular to vertical support plate 10 and straddles rotating striker plate window 18 with its first end adjacent to the outer surface of vertical support plate 10 and its second end adjacent to the inner surface of vertical support plate 10, as depicted. Rotating striker plate 60 further comprises a swing arm pivotal attachment point 62 located on the first end of plane one. Rotating striker plate 60 is pivotally attached to swing arm 50 by rotating striker plate pivotal attachment means 16. As stated, pivotal attachment could be accomplished by a hinge, a bearing, an axle, a hub, a spindle, a pin, a rivet, a screw, a bolt, or any other known means of pivotal attachment. Rotating striker plate 60 further comprises a swing arm pivotal attachment point 63 also located on plane one, at a location that is above vertical support plate pivotal attachment point 62. As stated, rotating striker plate 60 is pivotally attached to the upper end of swing arm 50 by upper pivotal attachment means 52. Rotating striker plate 60 further comprises a striker plate protrusion 64. Striker plate protrusion 64 is plane two of striker plate 60. Striker plate protrusion 64 functions to either: block striker plate window 18 to prevent spring loaded latch 72 from penetrating through striker plate window 18 in order to keep hinged lid 86 from locking shut or unblock striker plate window 18 to allow spring loaded latch 72 to penetrate through striker plate window 18 in order to lock hinged lid 86 shut. As a result of its mechanical connection or linkage to floating base plate 20, rotating striker plate 60 blocks striker plate window 10 when floating base plate 20 is in its upper most position and unblocks striker plate window 10 when floating base plate 20 is in its lower most position.

Latch assembly 70 comprises a housing, an internal lock mechanism (not depicted), a spring loaded latch 72, a key 74, and a keyhole 76. Internal lock mechanism is a lock mechanism that functions to retract spring loaded latch 72 in response to the turning of key 74 when positioned in keyhole 76. Internal lock mechanism is a standard lock mechanism that allows the user to retract spring loaded latch 72 with the rotation of key 74 when properly inserted into keyhole 76. Spring loaded latch 72 is a standard latch with bias pressure forcing the latch to extend outward, which can be overcome by pressing the spring loaded latch 72 inward with about 0.25-10 pounds of force.

To use self-locking parcel delivery box 5, self-locking parcel delivery box 5 is placed in empty unlocked condition at a location where packages or parcels are normally delivered. At the time of package or parcel 100 delivery, hinged lid 86 is lifted or opened, the package or parcel 100 is placed inside, where the weight of the package or parcel 100 pushes or forces floating base plate 20 downwards so that rotating striker plate 60 rotates downwards to unblock striker plate window 18. Hinged lid 86 is then closed and pushed shut so that spring loaded latch 72 penetrates through striker plate window 18 to effectuate the locking shut of hinged lid 86 on container 80. At the time of package or parcel 100 retrieval from self-locking parcel delivery box 5, key 74 is placed in keyhole 76 and rotated therein to cause spring loaded latch 72 to retract from penetrating through striker plate window 18 to allow for hinged lid 86 to unlock. Hinged lid 86 is then lifted or opened and package or parcel 100 is lifted off of floating base plate 20 and retrieved from container 80. The lifting of package or parcel 100 off of floating base plate 20 causes the floating base plate 20 to rise upwards to cause rotating striker plate 60 to rotate back upwards to block striker plate window 18 to allow for hinged lid to remain openable and unlocked until another package or parcel 100 is placed inside container 80.

What is claimed is:

1. Self-locking parcel delivery box comprising: a vertical support plate; a floating base plate; a floating stanchion; at least one spring; a swing arm; a rotating striker plate; a latch assembly; and a container, wherein, said vertical support plate is a rigid vertical planar member with a lower end, an upper end, an inner surface, an outer surface, a floating base plate window, at least one spring attachment point, a rotating striker plate pivotal attachment means, and a rotating striker plate window, said floating base plate is a rigid horizontal planar member with an upper surface, a lower surface, and at least one spring attachment point, said floating stanchion is a rigid oblong vertical support member with a lower end, an upper end, an inner surface, an outer surface, and a slideable attachment means, said at least one spring is a vertical spring member with an upper end and lower end, said swing arm is a rigid oblong member with a lower end, an upper end, a lower pivotal attachment means to pivotally attach said lower end of said swing arm to said upper end of said floating stanchion, and an upper pivotal attachment means to pivotally attach said upper end of said swing arm to said rotating striker plate, said rotating striker plate is a rigid tri-planar step-shaped member with a vertical support plate pivotal attachment point, a swing arm pivotal attachment point, and a striker protrusion, said latch assembly comprises a spring loaded latch, said container comprises: a container bottom, at least one container side, and a hinged lid, said lower end of said vertical support plate is rigidly attached to said container bottom, said upper surface of said floating base plate is rigidly attached to said lower end of said floating stanchion, said floating stanchion is slideably attached to said outer surface of said vertical support plate by said slideable attachment means, said lower end of said at least one spring is attached to said upper surface of said floating base plate, said upper end of said at least one spring is attached to said upper end of said vertical support plate, said lower end of said swing arm is pivotally attached to said upper end of said floating stanchion by said lower pivotal attachment means, said upper end of swing arm to is pivotally attached to said rotating striker plate by said upper pivotal attachment means, said rotating striker plate is pivotally attached to said upper end of Said vertical support member by said rotating striker plate pivotal attachment means, and said latch assembly is rigidly attached to said hinged lid.

* * * * *